US005230225A

United States Patent [19]

George, II et al.

[11] Patent Number: 5,230,225

[45] Date of Patent: Jul. 27, 1993

[54] ABSORPTION REFRIGERATION SYSTEM BURNER AND GENERATOR ASSEMBLY

[75] Inventors: Paul E. George, II, Dublin; James H. Saunders, Jr., Worthington, both of Ohio

[73] Assignee: Gas Research Institute, Chicago, Ill.

[21] Appl. No.: 885,669

[22] Filed: Aug. 17, 1992

[51] Int. Cl.[5] ..... F25B 15/00

[52] U.S. Cl. ..... 62/476; 122/14; 122/19

[58] Field of Search ..... 62/476; 122/14, 17, 122/18, 19; 110/244, 243

[56] References Cited

U.S. PATENT DOCUMENTS 3,526,211 9/1970 Corey ..... 122/14
4,926,659 5/1990 Christensen ..... 62/476

FOREIGN PATENT DOCUMENTS 0256043 8/1926 United Kingdom ..... 122/19

*Primary Examiner*—John M. Sollecito
*Attorney, Agent, or Firm*—Watkins, Dunbar & Pollick

[57] ABSTRACT

An absorption refrigeration system generator assembly is provided with a centrally positioned, generally vertical boiling pot element having a lower portion and an upper portion, with an annular primary combustion chamber surrounding the boiling pot element lower portion exclusive of the boiling pot member bottom surface, and with an optional contiguous secondary combustion chamber surrounding the boiling pot element upper portion. An included fuel/gas air supply and ignitor cooperates with the primary combustion chamber and causes combustion products to swirl over the lower and upper portions of the boiling pot element.

6 Claims, 2 Drawing Sheets

ABSORPTION REFRIGERATION SYSTEM BURNER AND GENERATOR ASSEMBLY

FIELD OF THE INVENTION

This invention relates generally to absorption refrigeration systems, and particularly concerns an improved burner and generator assembly which functions to increase the liquid flow and thermal efficiencies with which absorption refrigeration system refrigerant, usually water, is separated from a dilute absorption refrigeration system refrigeration liquid solution, usually lithium bromide and water, to obtain a relatively concentrated absorption refrigeration system refrigerant solution. Also, the burner and generator combination is considered useful in applications other than in an absorption refrigeration system.

BACKGROUND OF THE INVENTION

Numerous different types of generator assemblies for application to absorption refrigeration systems are known including generator assemblies which are powered by natural gas or other types of gaseous fuel. See, for instance, U.S. Pat. No. 4,926,659 issued in the name of Christensen, et al. Also, the use of cyclone-type burner assemblies in a variety of applications are well known. Representative known cyclone-type burner assemblies include those disclosed in U.S. Pat. No. 4,687,436 issued in the name of Shigeta for a distillation device, U.S. Pat. No. 4,351,251 issued in the name of Brashears for a drying kiln, U.S. Pat. No. 3,885,906 issued in the name of Shurygin et al. for incinerating fluid industrial waste, U.S. Pat. No. 3,459,414 issued in the name of Schmidt for heat-treating metal ingots or billets, U.S. Pat. No. 2,486,018 issued in the name of Furkert for melting metal, and U.S. Pat. No. 1,672,084 issued in the name of Press for domestic furnaces.

We have discovered that a cyclone-type burner may be advantageously combined with an absorption refrigeration system generator, particularly a generator having a generally vertical, boiling pot element with a high length to diameter aspect ratio, to prevent a "slugging" action which would otherwise occur and which impedes the flow of concentrated refrigerant solution from the generator assembly to the system absorber component. Also, we have further discovered that, when properly integrated with the system boiling pot element and cyclone burner combination, a novel dilute solution preheater element will further improve the thermal efficiency of separating refrigerant from dilute refrigeration solution for subsequent condensation apart from the system generator assembly.

Still other advantages of the invention will become apparent from a careful consideration of the specification and drawings which follow.

SUMMARY OF THE INVENTION

The generator assembly of this invention comprises a generally vertical, cylindrical, boiling pot element 12 which is surrounded at its lower extremities, but not at its bottom surface, by an annular primary combustion chamber 14 further surrounded by refractory 18 and at its upper extremities by an annular secondary combustion chamber element 16 comprising an extension of the primary combustion chamber element 14. In one configuration of the invention, the secondary combustion chamber 16 further includes a preheater coil element 22. In an alternate embodiment, and because the preheater coil element is omitted, the annular secondary combustion element is also surrounded by refractory.

A dilute refrigeration solution inlet 24 cooperates with the lower extreme of the preheater coil element; a concentrated solution outlet 29 cooperates with the boiling pot element lower extremity. A flow of fuel gas and air is introduced tangentially into the primary combustion chamber and ignited. The ignited mixture swirls about chamber 14, heats the surface of surrounding refractory 18, and transfers heat by direct contact with pot element 12. The refractory surface heated by the ignited mixture radiates and also provides heat to pot element 12. After leaving chamber 14, the combustion mixture continues swirling upwardly into the annular second combustion chamber for continuing combustion. Such continuing combustion provides heat by convection and radiation into both the surrounding preheater coil and the interior boiling pot element upper extremity. Dilute refrigeration solution heated in the preheater coil is flowed from the preheater coil into the boiling pot element near its upper extremity. The flue gas generated by fuel gas combustion is swirled upwardly over the preheater coil inner surfaces and downwardly over the preheater coil outer surfaces to a generator assembly exhaust outlet located generally midway between the assembly upper and lower extremes. Additional details regarding the generator assembly of this invention are best obtained from a consideration of the detailed description and drawings which follow.

DETAILED DESCRIPTION

Figure 1:
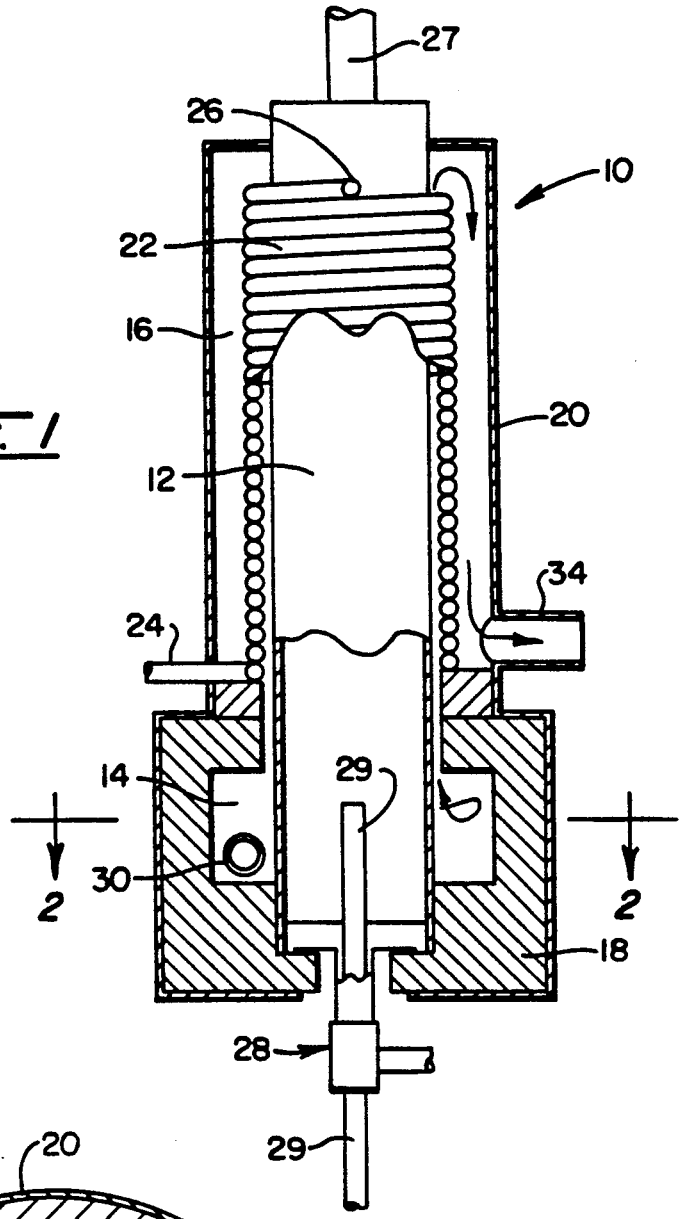
FIG. 1 is a schematic elevational view, partially in section, of a preferred embodiment of the absorption refrigeration system generator assembly of this invention.

FIG. 1 illustrates, schematically and partially in section, an elevational view of a preferred embodiment 10 of the absorption refrigeration system generator assembly of this invention. Assembly 10 basically comprises a centrally situated and generally vertically oriented solution boiling pot element 12 surrounded in its lower extreme by a generally annular primary combustion chamber 14 and in its upper extreme also by a generally annular secondary combustion chamber 16 which is contiguous to chamber 14. Chamber 14 is in turn surrounded by a conventional insulating refractory 18. A housing element 20, preferably formed of metal, surrounds and substantially contains elements 12 through 18.

Figure 2:
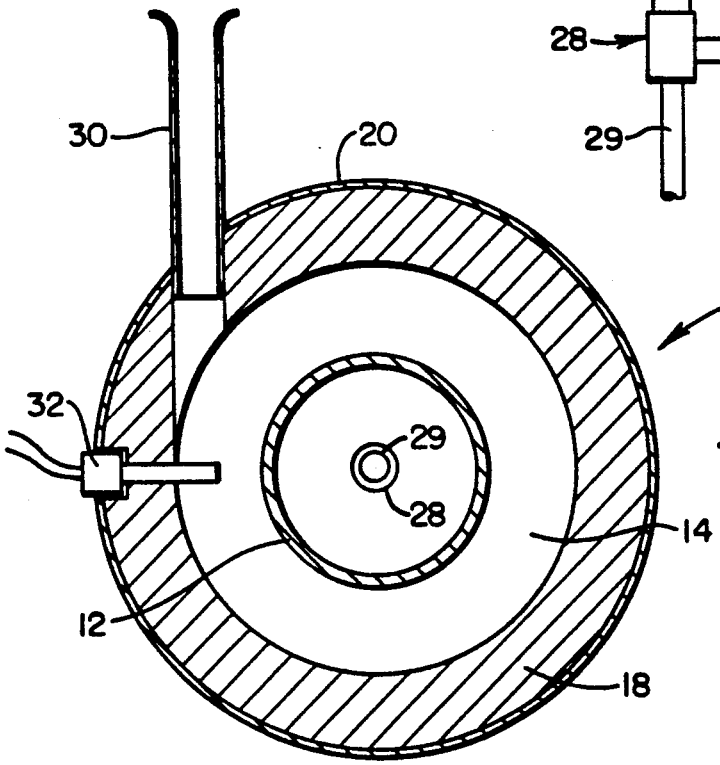
FIG. 2 is a sectional view taken at line 2—2 of FIG. 1.

Assembly 10 in the FIGS. 1 and 2 embodiment also is comprised of a generally annular fluid-to-fluid heat exchanger element 22 which preferably is configured as a closely coiled metallic tube. Such heat exchanger is advantageous for some applications of the invention but is not necessary in every instance. Heat exchanger 22 has an inlet 24 that receives relatively dilute absorption refrigeration system refrigerant solution from the refrigeration system evaporator element. Fluid flowed from inlet 24 and through coil 22 is flowed through a heat exchanger outlet 26 and into the interior of boiling pot 12 near the upper extreme of element 12.

Also, it is preferred that heat exchanger 22 be properly sized so that when positioned in secondary combustion chamber 16 its inner undulating, generally cylindrical surface is spaced apart from the outer cylindrical surface of boiling pot element 12 and its outer undulating, generally cylindrical surface is spaced apart from the inner surface of housing 20. Boiling pot element 12 is provided with an outlet 27 that flows refrigerant vapor (steam) from the pot interior to the refrigeration system condenser element (not shown). Boiling pot element 12 also is provided with an outlet 29 in its lower extreme that flows relatively concentrated refrigeration system refrigeration solution from the pot lower interior region to the refrigeration system evaporator/absorber element (also not shown). Further, it is generally preferred to provide assembly with a selectively operable (valved) drain 28 at the boiling pot element lower extreme for use in removing refrigeration solution and/or unwanted sediments from the assembly as necessary. Whereas the use of preheater coil is advantageous in some instances, it is not a necessary element in all applications of the invention.

As shown in FIG. 2, assembly 10 is also comprised of fuel gas/air inlet 30 that is positioned generally tangentially relative to the outer surface of annular primary combustion chamber 14. Lastly, a suitable conventional and selectively operable electrical ignition device 32 is located to project into chamber 14 in the path of fuel gas/air mixtures flowed through inlet 30.

During operation of generator assembly 10, the fuel gas/air mixture ignited by element 32 swirls spirally within primary combustion chamber 14 and its heat of combustion is partially transferred to the lower interior extreme of boiling pot element 12 to cause a boiling of any solution there present without "slugging", and also is radiated and partially transferred into refractory 18. The ignited mixture afterwards continues its combustion and spiral flow into secondary combustion chamber 16 in the region between the outer surface of boiling pot element 12 and the inner surface of annular heat exchanger element 22 to cause a further heating of refrigeration solution in the interior of boiling pot 12 and also a preliminary heating of refrigeration solution being flowed through heat exchanger 22. The residual gases from the combustion afterwards pass over the top turn of heat exchanger 22 and are flowed generally downwardly in that annular portion of secondary combustion chamber 16 which is situated between the outer surface of heat exchanger 22 and the adjacent inner surface of housing 20 to exhaust outlet 34 causing a still further preliminary heating of refrigeration solution being flowed through heat exchanger 22 to the interior of boiling pot element 12.

Figure 3:
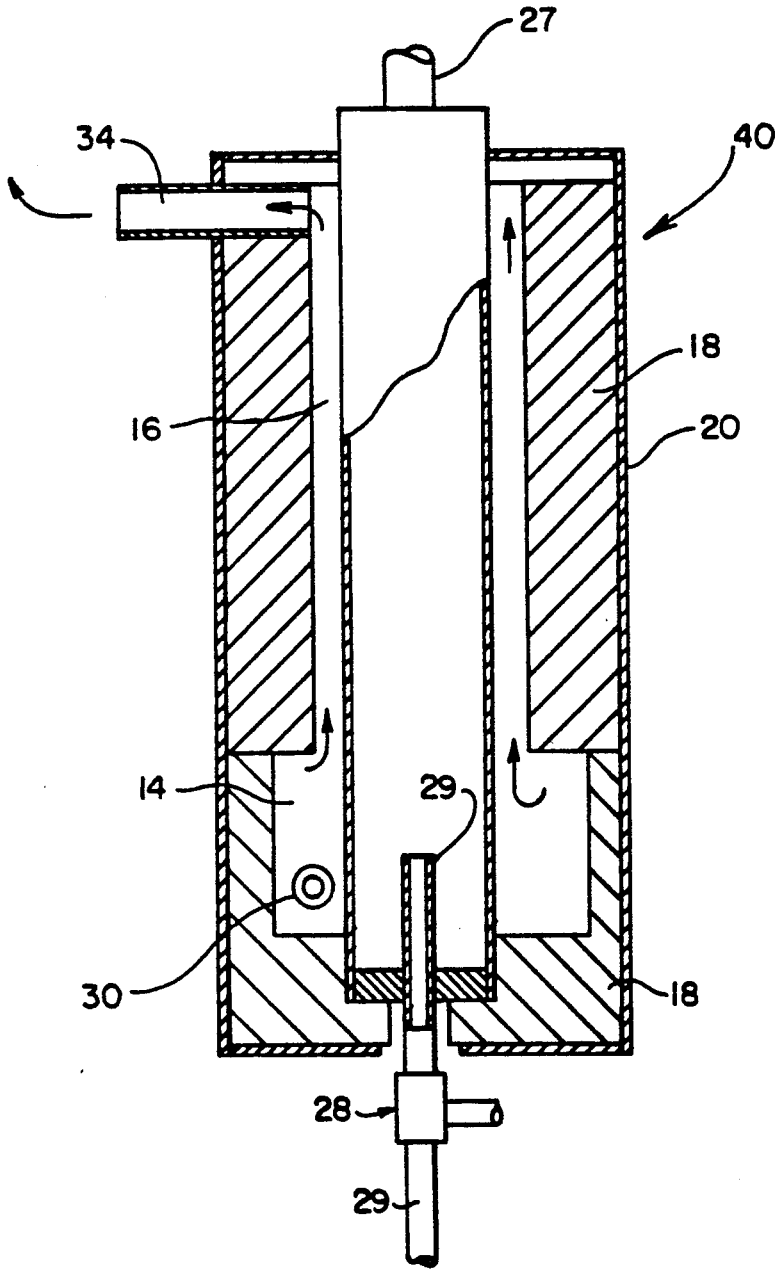
FIG. 3 is a sectional view, similar to FIG. 1, but of an alternate embodiment of the invention.

FIG. 3 is provided in the drawings to illustrate the alternate embodiment of the invention assembly not having a preheater coil element 22. The secondary combustion chamber 16 is encircled by additional refractory in lieu of containing the otherwise included preheater coil element.

It is herein understood that although the present invention has been specifically disclosed with the preferred embodiments and examples, modifications and variation of the concepts herein disclosed may be resorted to by those skilled in the art. Such modifications and variations are considered to be within the scope of the invention and the appended claims.

We claim:

1. An absorption refrigeration system burner and generator assembly comprising:

a) a centrally positioned and vertically oriented boiling pot member having a generally uninsulated lower portion but with an insulated bottom and an uninsulated upper portion;

b) a generally annular and insulated primary combustion chamber means surrounding said boiling pot means surrounding said boiling pot means uninsulated lower portion;

c) a generally annular enclosed secondary combustion chamber means surrounding said boiling pot means upper portion in contiguous relation to said primary combustion chamber means;

d) refrigeration solution preheater means situated in said secondary combustion chamber means in a surrounding and spaced-apart relationship to said boiling pot means upper portion;

e) fuel gas/air supply and ignitor means cooperating with said primary combustion chamber means; and f) outlet means positioned generally centrally in said boiling pot means uninsulated lower portion insulated bottom to flow relatively concentrated refrigeration solution from within said boiling pot means without periodic slugging, said fuel gas/air supply and ignitor means being positioned and oriented to cause fuel gas/air mixtures supplied to said primary combustion chamber and ignited to combust along a spiral path which surrounds said boiling pot means lower portion and which passes in said secondary combustion chamber means between said refrigeration solution preheater means and said boiling pot means upper portion.

2. The assembly defined by claim 1 wherein said refrigeration solution preheater means is a closely-coiled metallic tube means having an undulating exterior surface spaced apart from and opposing the exterior surface of said boiling pot means upper portion.

3. The assembly defined by claim 1 and further comprising an exhaust outlet cooperating with said secondary combustion chamber means at a region adjacent the lower extreme of said refrigeration solution preheater means, said exhaust outlet receiving combustion product gases flowed upwardly between said preheater means and said boiling pot means upper portion and afterwards flowed downwardly over an outer surface of said preheater means away from said boiling pot means upper portion.

4. The assembly defined by claim 1 wherein said primary combustion chamber means is insulated by a refractory composition.

5. An absorption refrigeration system burner and generator assembly comprising:

a) a centrally positioned and vertically oriented boiling pot means of high aspect ratio having an insulated bottom surface;

b) a generally annular and insulated primary combustion chamber means surrounding said boiling pot means lower portion exclusive of the bottom surface of the boiling pot means;

c) a generally annular enclosed secondary combustion chamber means surrounding said boiling pot means upper portion in contiguous relation to said primary combustion chamber means;

d) fuel gas/air supply and ignitor means cooperating with said primary combustion chamber means; and e) outlet means positioned generally centrally in said boiling pot means insulated bottom surface to flow relatively concentrated refrigeration solution from within said boiling pot means without periodic slugging, said fuel gas/air supply ignitor means being positioned and oriented to cause fuel gas/air mixtures supplied to said primary combustion chamber and ignited to combust along a spiral path which surrounds said boiling pot means lower portion and which passes through said secondary combustion chamber means.

6. The assembly defined by claim 5 wherein said primary combustion chamber means is insulated by a refractory composition.

* * * * *

UNITED STATES PATENT AND TRADEMARK OFFICE

CERTIFICATE OF CORRECTION

PATENT NO. : 5,230,225

DATED : July 27, 1993

INVENTOR(S) : George II, et al.

It is certified that error appears in the above-identified patent and that said Letters Patent is hereby corrected as shown below:

Column 4, lines 8-9, after "surrounding said boiling pot means", delete "surrounding said boiling pot means".

Signed and Sealed this

Eighth Day of March, 1994

Bruce Lehman

*Attest:*

BRUCE LEHMAN

*Attesting Officer*

*Commissioner of Patents and Trademarks*